US006739646B2

(12) United States Patent
Suzuki et al.

(10) Patent No.: US 6,739,646 B2
(45) Date of Patent: May 25, 2004

(54) OPENING AND CLOSING DEVICE FOR A VEHICLE DOOR

(75) Inventors: Shintaro Suzuki, Kasugai (JP); Eiji Itami, Chiryu (JP); Ichiro Kondo, Okazaki (JP); Hiroyuki Yogo, Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 142 days.

(21) Appl. No.: 10/086,242

(22) Filed: Mar. 4, 2002

(65) Prior Publication Data

US 2003/0025337 A1 Feb. 6, 2003

(30) Foreign Application Priority Data

Mar. 2, 2001 (JP) ..... 2001-058158

(51) Int. Cl.[7] ..... B60J 5/04
(52) U.S. Cl. ..... 296/155; 49/280
(58) Field of Search ..... 296/155, 146.4; 49/139, 140, 360, 280

(56) References Cited

U.S. PATENT DOCUMENTS 5,836,639 A * 11/1998 Kleefeldt et al. ..... 296/155
6,089,649 A * 7/2000 Hamada et al. ..... 296/155
6,588,829 B2 * 7/2003 Long et al. ..... 296/155

FOREIGN PATENT DOCUMENTS

JP 10-61316 A 3/1998
JP 2000-160935 A 6/2000

* cited by examiner

*Primary Examiner*—Joseph D. Pape
(74) *Attorney, Agent, or Firm*—Burns, Doane, Swecker & Mathis, L.L.P.

(57) ABSTRACT

A vehicle is provided with an opening and closing device for opening and closing the vehicle door. A hook mechanism holds the door in an open condition, an electric releasing actuator is operatively connected to the hook mechanism to unhook the hook mechanism for permitting the door to be moved in the closing direction, an electric driving device is adapted to move the door in the closing direction, and an operation device generates a signal for directing that the door be moved in the closing direction. In addition, a control device controls the operation of the electric releasing actuator based upon the signal from the operation device, and controls the electric driving device to initiate driving operation of the electric driving device after initiation of the operation of the electric releasing actuator.

20 Claims, 9 Drawing Sheets

OPENING AND CLOSING DEVICE FOR A VEHICLE DOOR

This application is based on and claims priority under 35 U.S.C. §119 with respect to Japanese Application No. 2001-058158 filed on Mar. 2, 2001, the entire content of which is incorporated herein by reference.

FIELD OF THE INVENTION

This invention generally relates to vehicle doors. More particularly, the present invention pertains to an opening and closing device for a vehicle door. More particularly, this invention pertains to a vehicle door opening and closing device provided with a hook mechanism for holding a vehicle door under a door opened condition relative to a vehicle body and a moving mechanism for moving the vehicle door relative to the vehicle body.

BACKGROUND OF THE INVENTION

There are a variety of known opening and closing devices for opening and closing a vehicle door. Japanese Patent Laid-Open Publication 2000-160935 discloses one such vehicle door opening and closing device. The device described in this document includes a slide door movably supported by a vehicle body so as to open and close an opening defined in the vehicle body for allowing an individual to enter and exit the interior of the vehicle. The vehicle door opening and closing device is provided with an open position holding mechanism, a moving mechanism, and an electric driving mechanism. The open position holding mechanism holds the slide door under a door opened condition relative to the vehicle body, while the moving mechanism slidably moves the slide door relative to the vehicle body. The electric driving mechanism is operatively connected to the moving mechanism for operating the moving mechanism to slidably move the slide door for closing the opening.

The open position holding mechanism holds the slide door in the door opened condition by the biasing force of a biasing mechanism such as a spring. The open position holding mechanism is operated when the moving force of the slide door moving in the closing direction under operation of the moving mechanism operated by the electric driving mechanism exceeds the biasing force of the open position holding mechanism.

The vehicle door opening and closing device described above is susceptible of certain improvements. For example, when the electric driving mechanism is not operated while the vehicle is parked in a down-hill, the slide door may slidably move by itself in the closing direction. Therefore, the open position holding mechanism may be operated and the slide door may not be held at the door opened position.

Accordingly, a need exists for a vehicle door opening and closing device that is able to reliably hold the slide door in the door opened position.

SUMMARY OF THE INVENTION

A vehicle provided with an opening and closing device for a vehicle door includes a vehicle body having an opening which permits access into and out of the vehicle, a vehicle door movably supported by the vehicle body for opening and closing the opening, a hook mechanism which holds the vehicle door relative to the vehicle body under a door opened condition, a moving mechanism which moves the vehicle door relative to the vehicle body, an electric releasing actuator operatively connected to the hook mechanism to operate the hook mechanism and effect unhooking of the hook mechanism to permit the vehicle door to be moved in a closing direction to close the opening, an electric driving device operatively connected to the moving mechanism to operate the moving mechanism and move the vehicle door in the closing direction relative to the vehicle body to close the opening, and an operation means for generating a signal indicating that the vehicle door is to be moved in the closing direction to close the opening. A control means controls the operation of the electric releasing actuator based on the signal from the operation means and controls the operation of the electric driving device to initiate driving of the moving mechanism after initiating operation of the electric releasing actuator.

The operation of the hook mechanism is performed by driving the electric releasing actuator. Therefore, the hook mechanism is not operated even when the vehicle door is applied with a force which moves the door in a closing direction for closing the opening. That is, the operation of the hook mechanism is not associated with the moving force applied to the vehicle door upon a closing operation of the vehicle door. Therefore, the vehicle door can be reliably held at the door opened position relative to the vehicle body.

It is preferable that the control means includes a timing means for commencing counting from the initiation of the operation of the electric release motor. The control means terminates the operation of the electric release motor and controls starting of the operation the electric driving device based upon the lapsed time counted by the timing means from the initiation of the operation of the electric release motor.

In addition, a detecting means detects the movement of the vehicle door relative to the vehicle body, with the control means terminating operation of the electric releasing actuator based upon the movement of the vehicle door detected by the detecting means or the lapsed time counted by the timing means. The timing means and the detecting means allow termination of the operation of the electric release motor and the starting of operation of the electric driving mechanism. Therefore, the hook mechanism is not required to be additionally provided with a detecting means for detecting the operation of the hook mechanism. This leads to a decrease in the number of components and a reduction in the manufacturing cost.

According to another aspect, a method for closing an opening defined in a vehicle body of a vehicle through movement of a vehicle door relative to the vehicle body involves operating an electric release motor operatively connected to a hook mechanism holding the vehicle door at an open condition to unhook the hook mechanism, with the driving of the electric release motor being initiated based upon operation of a switch, counting lapsed time from initiation of the operation of the electric release motor, judging whether the lapsed time from the initiation of the operation of the electric release motor is at least equal to a first predetermined time, and initiating driving of an electric driving mechanism for moving the vehicle door in a closing direction relative to the vehicle body based on whether the lapsed time from the initiation of operation of the electric release motor is at least equal to the first predetermined time.

In accordance with another aspect, a method for closing an opening defined in a vehicle body of a vehicle through movement of a vehicle door relative to the vehicle body includes directing a door closing operation of the vehicle door that is in an open condition, releasing a hook mechanism holding the door at the open condition by operation of a first motor operatively connected to the hook mechanism, counting lapsed time from initiation of operation of the first motor, and operating a second motor to move the vehicle door relative to the vehicle body in a closing direction based upon the lapsed time from the initiation of operation of the first motor.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
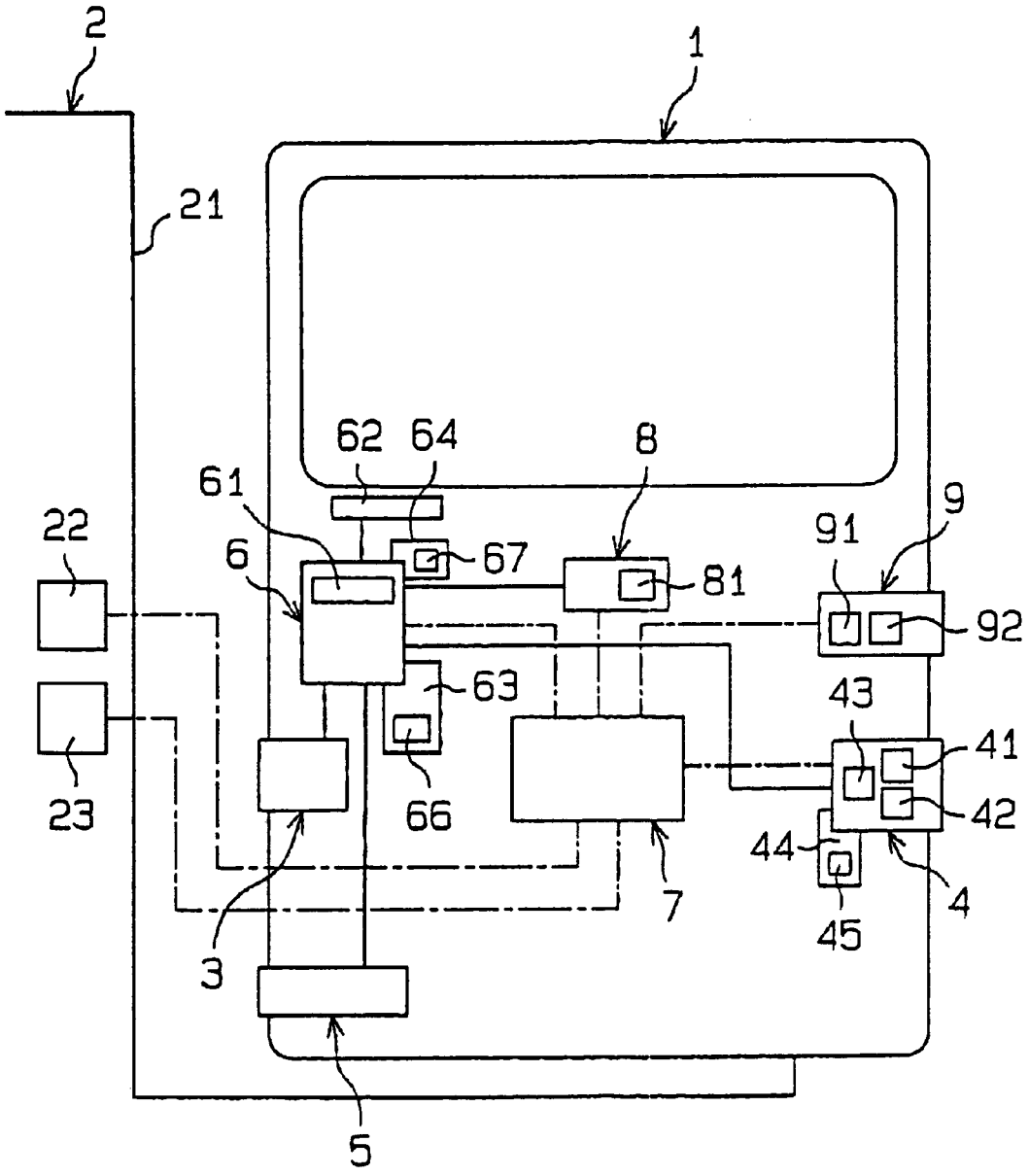
FIG. 1 is a side view of a vehicle door schematically illustrating the vehicle door provided with an opening and closing device according to the present invention.

Referring to FIG. 1, a vehicle body 2 of a vehicle is provided with an opening 21 that allows access into the interior of the vehicle to allow individuals to enter and exit the vehicle interior. A vehicle door 1 is movably supported by the vehicle body 2 and is slidably movable relative to the vehicle body 2 in the vehicle longitudinal direction. The vehicle door 1 can be held at a door closed condition in which the opening 21 in the vehicle body is closed and at a door opened condition in which the opening 21 in the vehicle body is opened and accessible.

The vehicle door 1 is provided with a pair of latch mechanisms 3, 4 and a hook mechanism 5. The latch mechanisms 3, 4 are respectively arranged at the front and rear portions of the vehicle door 1 for holding the vehicle door 1 under the door closed condition relative to the vehicle body 2. The hook mechanism 5 is employed for holding the vehicle door 1 under the door opened condition relative to the vehicle body 2. The vehicle door 1 is further provided with an inside handle 61 at the inner side of the vehicle door 1, an outside handle 62 at the outer side of the vehicle door 1, and a remote control mechanism 6. The inside handle 61, the outside handle 62, the latch mechanisms 3, 4 and the hook mechanism 5 are physically connected via the remote control mechanism 6 by way of a connecting means including a rod and a cable. Therefore, the remote control mechanism 6 operates the latch mechanisms 3, 4 and the hook mechanism 5 through an individual's manual operation of the inside handle 61 or the outside handle 62.

The remote control mechanism 6 with a known construction formed of plural levers is provided with a lock actuator 63 and a child protecting mechanism 64. The lock actuator 63 establishes a door locked condition of the vehicle door 1 in which the connection between the inside handle 61 and the latch mechanisms 3, 4, and the connection between the outside handle 62 and the latch mechanisms 3, 4 are interrupted. The child protecting mechanism 64 is employed for locking the vehicle door 1 to protect a child from opening the vehicle door 1 (a child locking condition). In this case, the connection between the inside handle 61 and the latch mechanisms 3, 4 is interrupted. The lock actuator 63 is provided with a lock switch 66 (referred to as a lock SW in the flow chart illustrated in FIG. 6) for detecting the door locked condition of the vehicle door 1 and for transmitting an ON signal to a controller 7 while the vehicle door 1 is under the door locked condition. The child protecting mechanism 64 is provided with a child protecting switch 67 (referred to as a child-protect SW in the flow chart illustrated in FIG. 6) for detecting the child locking condition of the vehicle door 1 and for transmitting an ON signal to the controller 7 while the vehicle door 1 is under the child locking condition.

The latch mechanisms 3, 4 are formed of a known construction including a latch and a pawl, respectively. The latch is freely rotatably engageable with and disengageable from a striker fixed to the vehicle body 2. The pawl is engageable with and disengageable from the latch. The latch mechanisms 3, 4 establish a full-latched condition in which the vehicle door 1 is held under a door full-closed condition, a half-latched condition in which the vehicle door 1 is held under a door half-closed condition, and an unlatched condition in which the vehicle door 1 is slidably movable in a direction for opening the opening 21.

Figure 5:
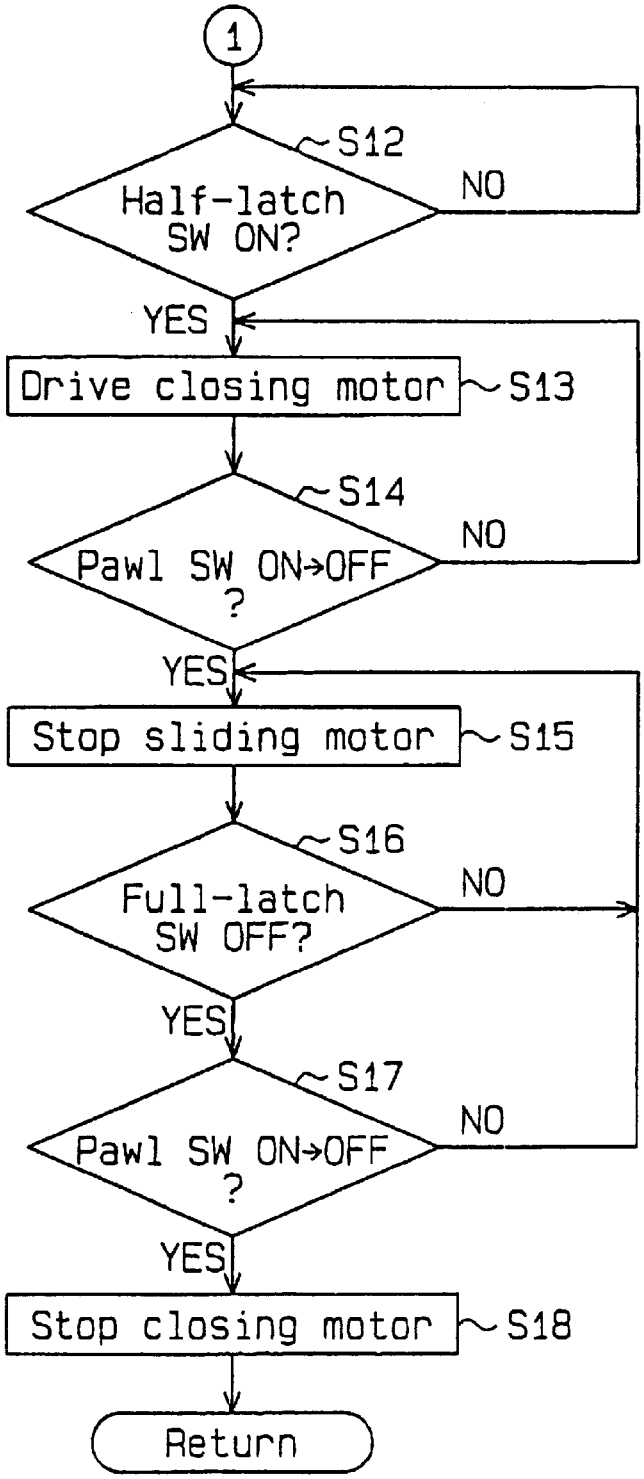
FIG. 5 is a flow chart illustrating another part of the subroutine associated with the door closing operation mode carried out in the main routine shown in FIG. 3.
Figure 6:
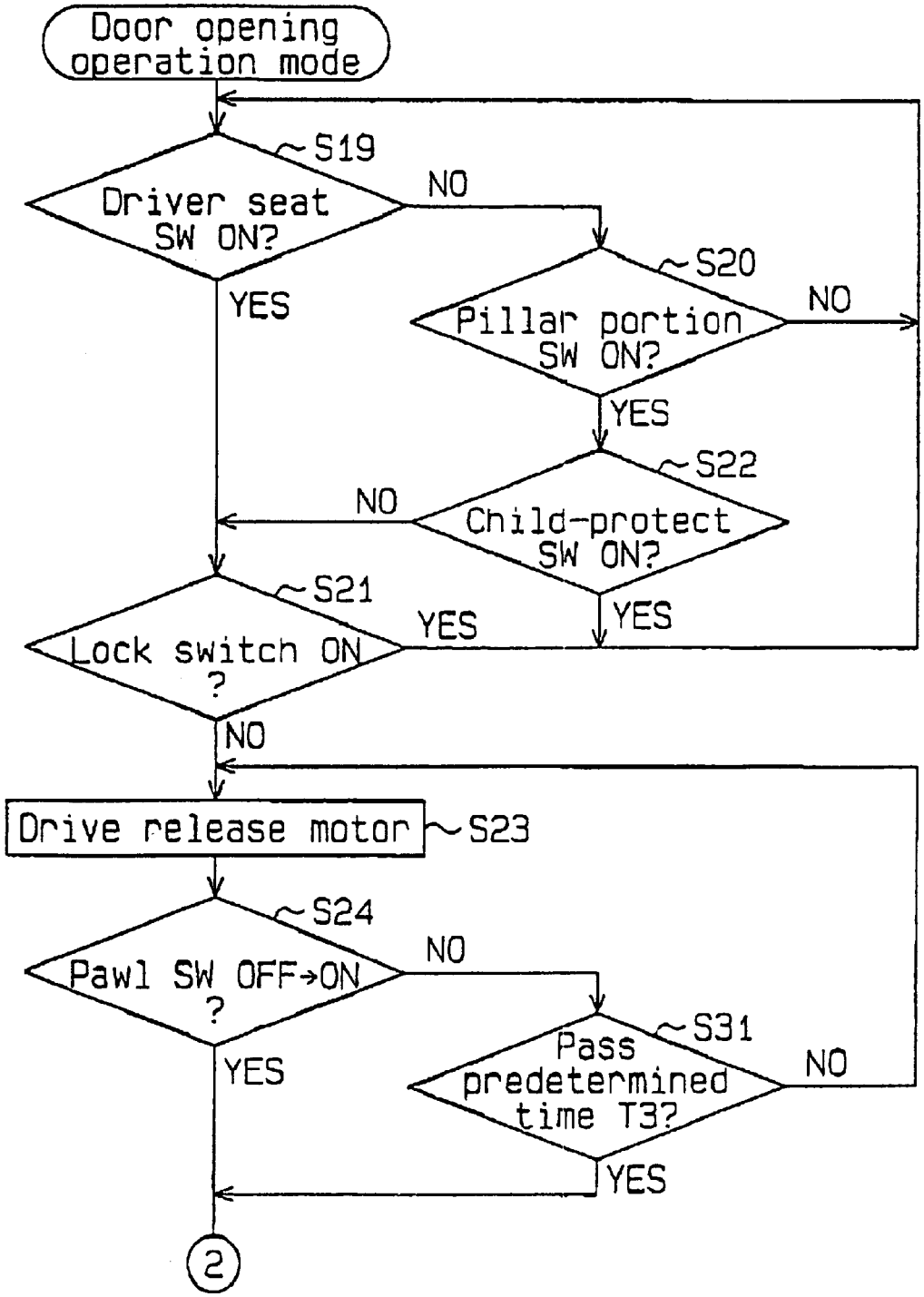
FIG. 6 is a flow chart illustrating a part of the subroutine associated with the door opening operation mode carried out in the main routine shown in FIG. 3.
Figure 7:
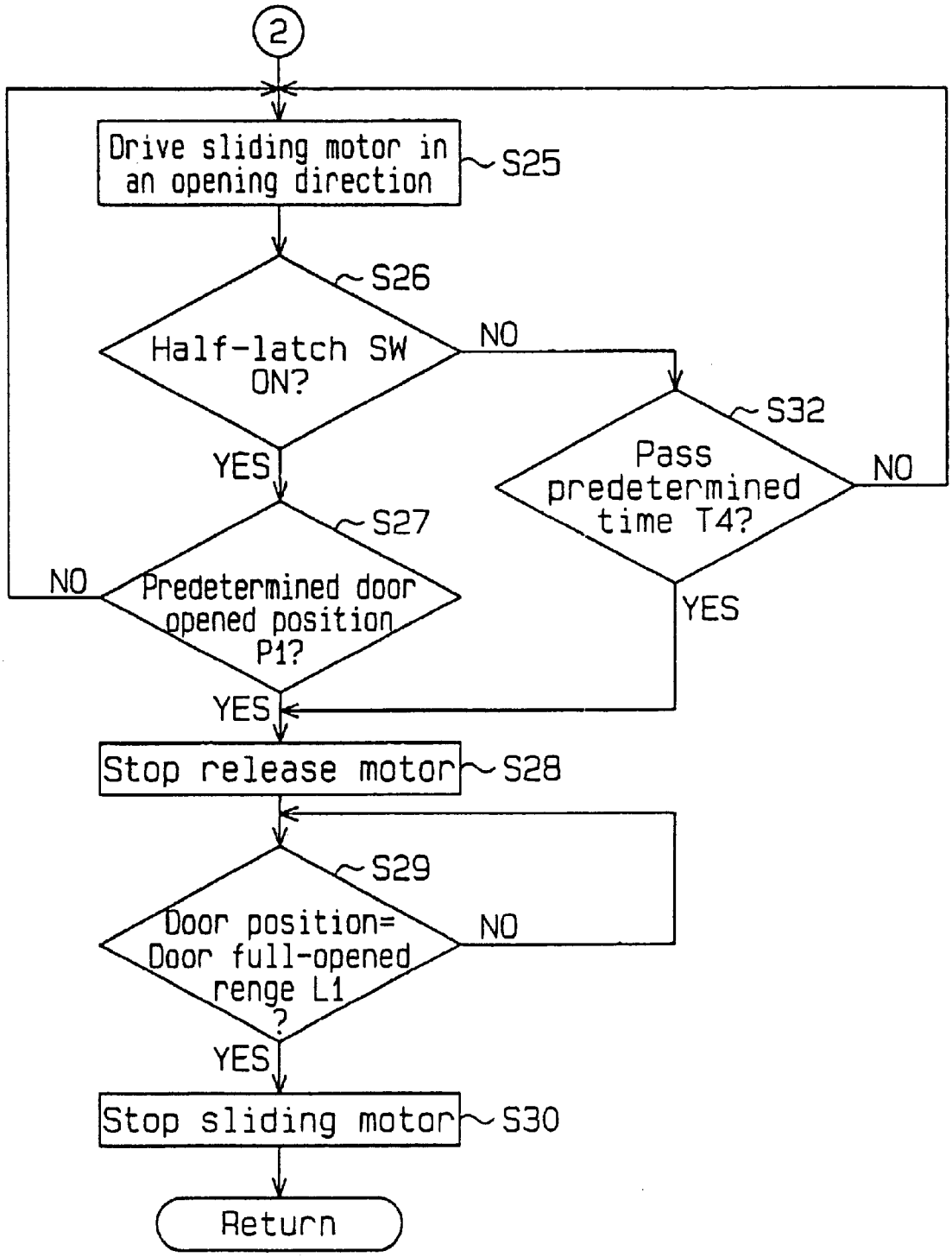
FIG. 7 is a flow chart illustrating another part of the subroutine associated with the door opening operation mode carried out in the main routine shown in FIG. 3.
Figure 8:
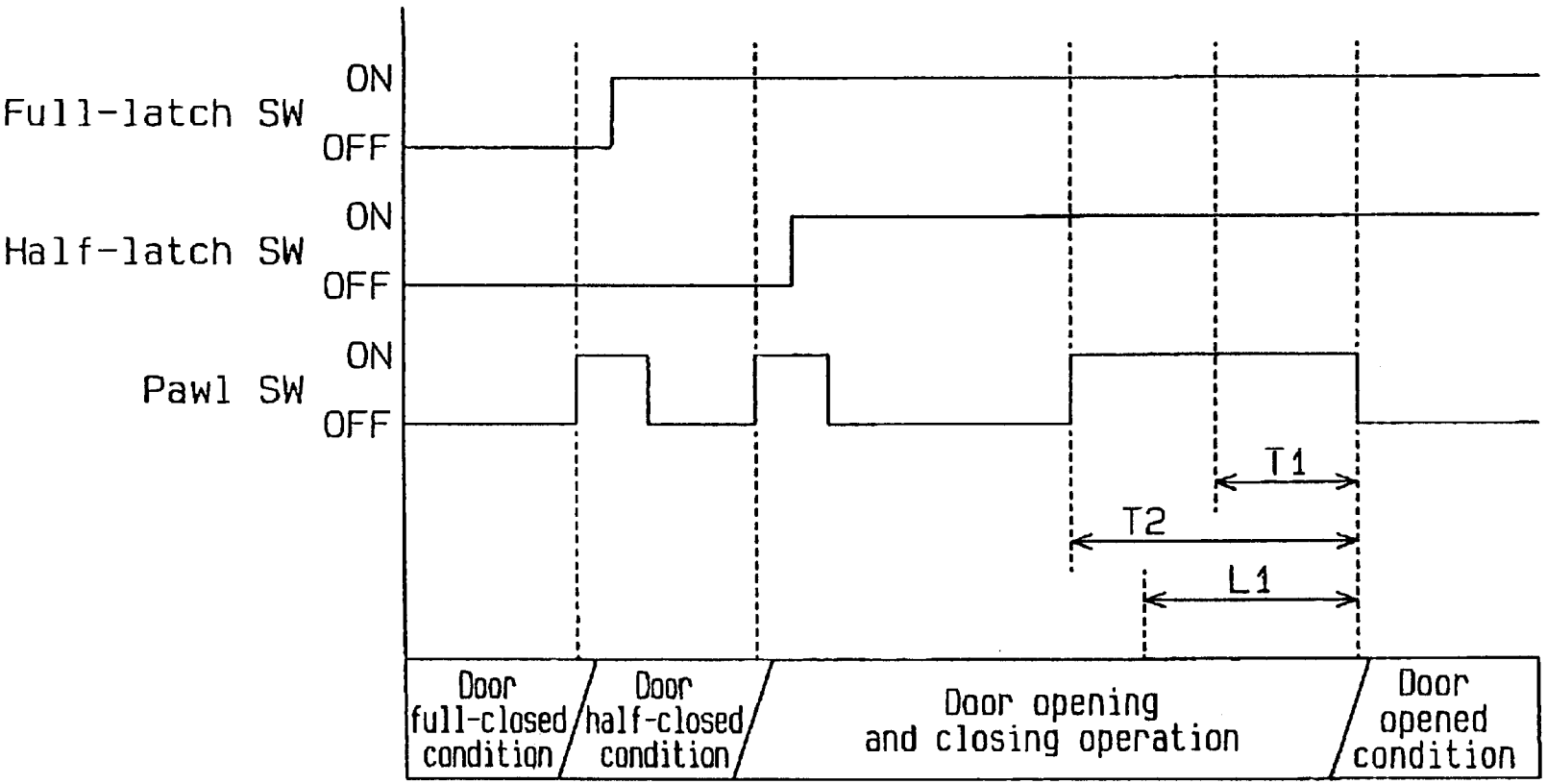
FIG. 8 is a timing chart illustrating the operation of the vehicle door opening and closing device for the door closing operation of the vehicle door.
Figure 9:
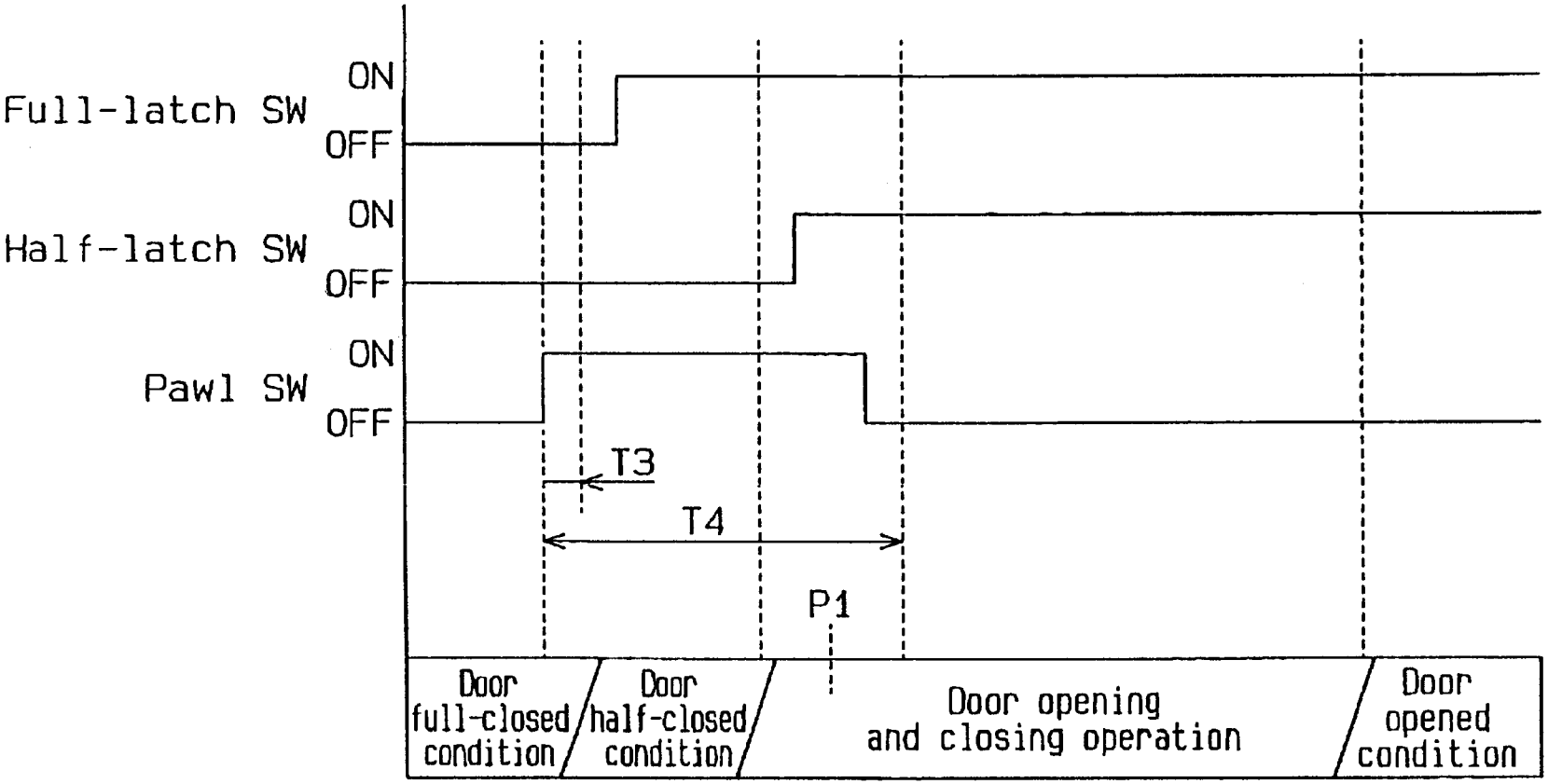
FIG. 9 is a timing chart illustrating the operation of the vehicle door opening and closing device for the door opening operation of the vehicle door.

The latch mechanism 4 is provided with a full-latch switch 41 (referred to as a full-latch SW in the flow chart illustrated in FIG. 5 and in the timing charts illustrated in FIGS. 8 and 9) for detecting the full-latched condition of the latch mechanism 4, a half-latch switch 42 (referred to as a half-latch SW in the flow charts illustrated in FIGS. 5 and 7 and in the timing charts illustrated in FIGS. 8 and 9) for detecting the half-latched condition of the latch mechanism 4, and a pawl switch 43 (referred to as a pawl SW in the flow charts illustrated in FIGS. 5 and 6 and in the timing charts illustrated in FIGS. 8 and 9) for detecting movement of the pawl establishing the full-latched condition, the half-latched condition, and the unlatched condition.

As illustrated in FIG. 8, the full-latch switch 41 detects from the condition of the latch mechanism 4 that the vehicle door 1 has not reached the door full-closed condition while the opening 21 is opened and outputs an ON signal to the controller 7. With the latch mechanism in the half-latched condition, the full-latch switch 41 outputs an OFF signal to the controller 7 through switching operation of the switch immediately before the latch mechanism 4 reaches or becomes the full-latched condition. The half-latch switch 42 detects from a condition of the latch mechanism 4 that the vehicle door 1 has not reached the door half-closed condition while the opening 21 is opened and outputs an ON signal to the controller 7. With the latch mechanism in the unlatched condition, the half-latch switch 42 outputs an OFF signal to the controller 7 through a switching operation of the switch immediately before the latch mechanism 4 reaches or becomes the half-latched condition. The pawl switch 43 outputs an OFF signal when the pawl is engaged with the latch and outputs an ON signal when the pawl is disengaged from the latch. That is, the pawl switch 43 selectively outputs the ON and OFF signals in response to the movement of the pawl establishing the full-latched condition, the half-latched condition, and the unlatched condition.

The latch mechanism 4 is further provided with an electric closing mechanism 44 for shifting the latch mechanism 4 from the half-latched condition to the full-latched condition. The electric closing mechanism 44 is formed of a known construction including an electric motor 45 (referred to as a closing motor in the flow chart illustrated in FIG. 5) as a driving power source. The latch of the latch mechanism 4 is rotated by a latch lever (not shown) in response to rotation of the electric motor 45.

The hook mechanism 5 is formed of a construction including a hook that is freely rotatably engaged with and disengaged from an engagement pin provided at the vehicle body 2. The hook mechanism 5 establishes a hooked condition in which the vehicle door 1 is held under the door opened condition, and an unhooked condition in which the vehicle door 1 is slidably movable in the closing direction for closing the opening 21.

Figure 4:
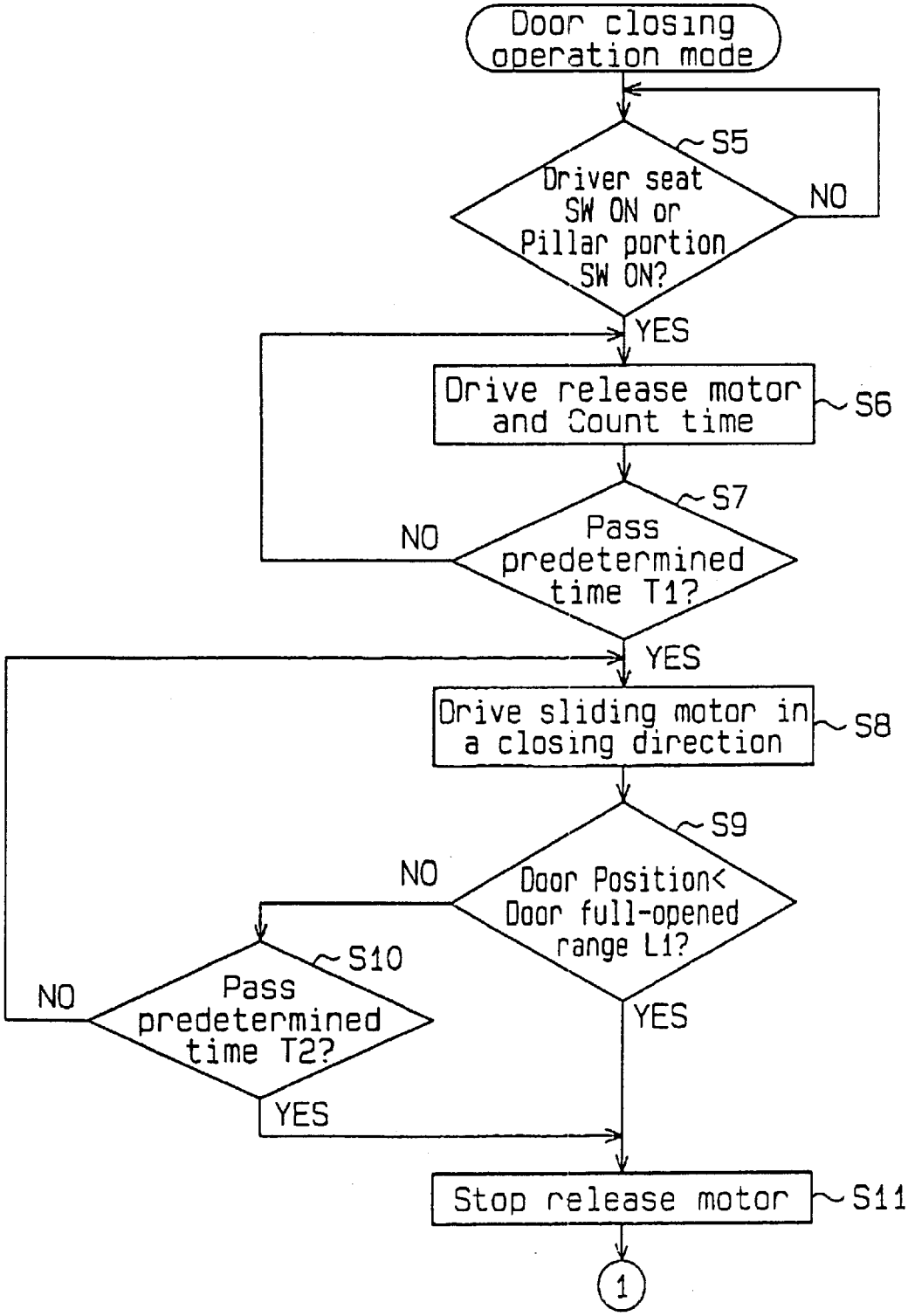
FIG. 4 is a flow chart illustrating a part of the subroutine associated with the door closing operation mode carried out in the main routine shown in FIG. 3.

The vehicle door 1 is provided with an electric releasing actuator 8 including an electric motor 81 (referred to as a release motor in the flow charts illustrated in FIGS. 4, 6 and 7) as a driving power source. The electric releasing actuator 8 is physically connected to the pair of latch mechanisms 3, 4 and the hook mechanism 5 via the remote control mechanism 6 by means of a connecting mechanism that includes a rod and a cable. Therefore, the latch mechanisms 3, 4 and the hook mechanism 5 are operated by driving or operating the electric motor 81.

The vehicle door 1 is further provided with an electric sliding mechanism or moving mechanism 9 provided with an electric motor 91 (referred to as a sliding motor in the flow charts illustrated in FIGS. 5, 7) as a driving power source. The electric sliding mechanism 9 is formed of a known construction including a cable connected to the vehicle body 2 and a drum for winding the cable. The vehicle door 1 can be slidably moved relative to the vehicle body 2 in the opening direction for opening the opening 21 when the drum is rotated by the motor or electric driving device 91 for rolling up the cable. On the other hand, the vehicle door 1 can be slidably moved relative to the vehicle body 2 in the closing direction for closing the opening 21 when the drum is rotated by the motor 91 for sending out the cable. The electric sliding mechanism or moving mechanism 9 is further provided with a position sensor 92 (e.g., a Hall IC) for detecting the rotational number or number of rotations of the electric motor 91.

Figure 2:
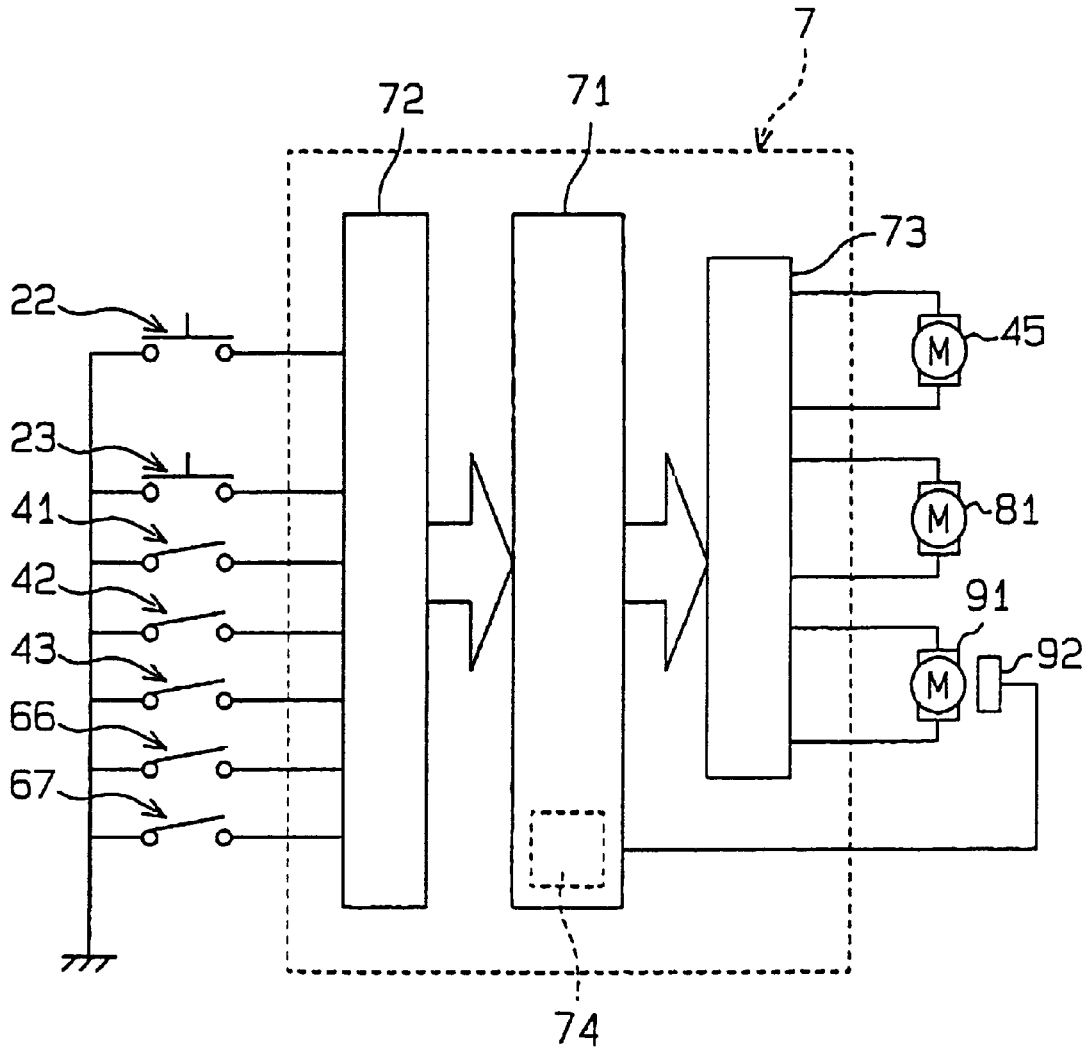
FIG. 2 is a schematic block diagram of the vehicle door opening and closing device.
Figure 3:
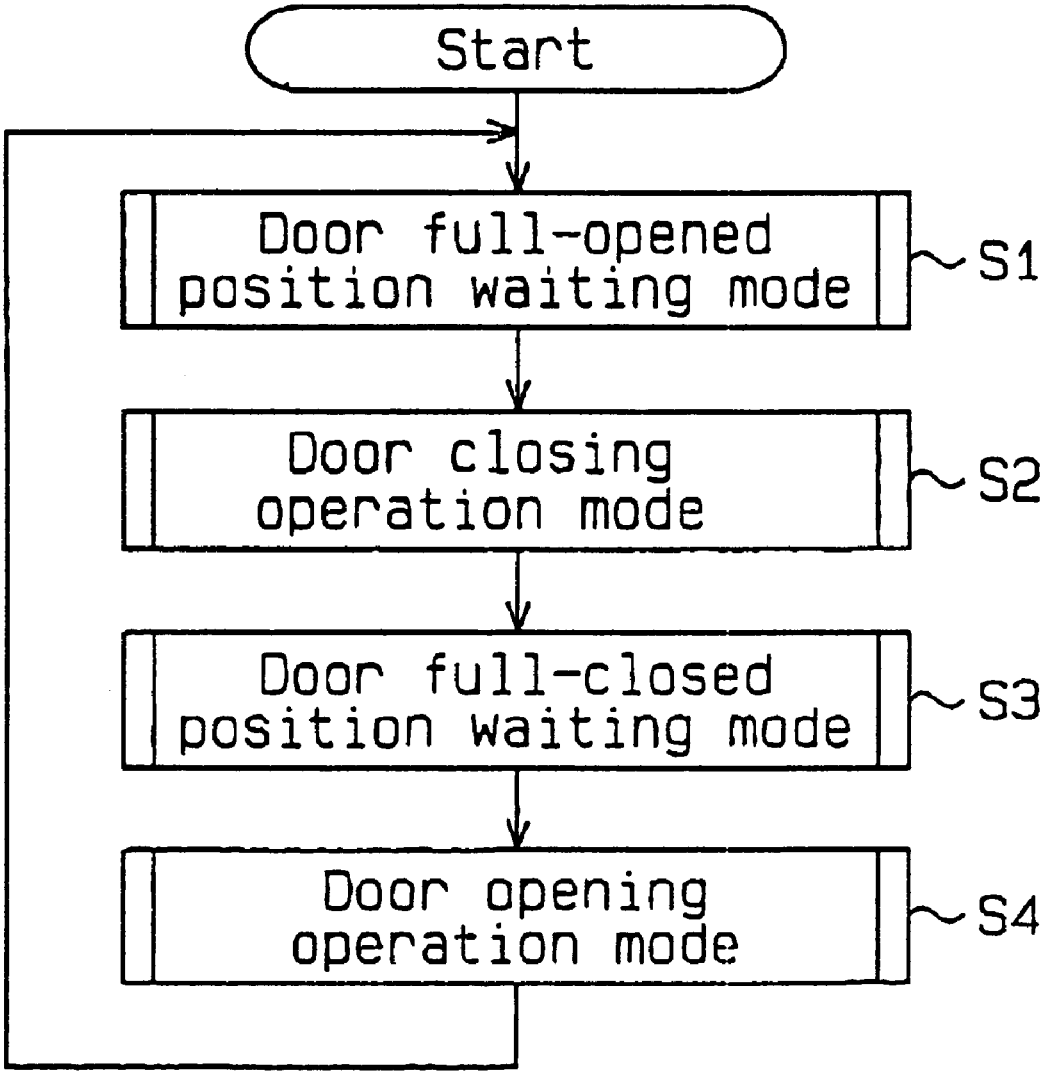
FIG. 3 is a flow chart illustrating the main routine associated with the control operation of the vehicle door opening and closing device.

The vehicle door 1 is further provided with the controller 7 for controlling the operation of the electric releasing actuator 8, the electric sliding mechanism 9, and the electric closing mechanism 44 by way of a central processing unit CPU 71. As illustrated in FIG. 2, the CPU 71 included in the controller 7 is electrically connected to the child protecting switch 67, the lock switch 66, the full-latch switch 41, the half-latch switch 42, and the pawl switch 43 via an input interface 72 through a connecting means including a wire harness so as to receive signals from the switches 41 42, 43, 66, 67. The CPU 71 is also electrically connected to the electric motors 45, 81, 91 via a driving circuit 73 through a connecting means including a wire harness. The CPU 71 is further electrically connected to a driver seat switch 22 (referred to as the driver seat SW in the flow charts illustrated in FIGS. 4 and 6) and a pillar portion switch 23 (referred to as a pillar portion SW in the flow charts illustrated in FIGS. 4 and 6) via the input interface 72 through a connecting means including a wire harness.

The CPU 71 also includes a timer 74 for counting two lapsed times T1, T2. The CPU 71 is electrically connected to the position sensor 92 by a connecting means including a wire harness to calculate a position of the vehicle door 1 relative to the vehicle body 2 based upon a signal from the position sensor 92.

Referring to the flow charts illustrated in FIGS. 3–7 and the timing charts illustrated in FIGS. 8 and 9, the operation of the controller 7 is as follows. Considering initially the flow chart illustrated in FIG. 3 and the timing charts illustrated in FIGS. 8 and 9, an initial process is performed at step S1 when the vehicle door 1 is under the door fully-opened condition relative to the vehicle body 2. More specifically, the CPU 71 observes the condition of the full-latch switch 41, the half-latch switch 42 and the pawl switch 43, and judges that the full-latch switch 41 and the half-latch switch 42 are ON and the pawl switch 43 is OFF. An operational process for the closing operation of the vehicle door 1 is performed at step S2 based upon the condition of the driver seat switch 22 or the pillar portion switch 23. An initial process is performed at step S3 under a door full-closed condition of the vehicle door 1 relative to the vehicle body 2. More specifically, the CPU 71 observes each condition of the full-latch switch 41, the half-latch switch 42, and the pawl switch 43 and judges that the each switch 41, 42, and 43 is OFF. An operational process for effecting the opening operation of the vehicle door 1 is then performed at step S4 based upon the condition of the driver seat switch 22 or the pillar portion switch 23.

The door closing operation mode of the vehicle door 1 carried out in step S2 of FIG. 2 is described below with reference to the flow charts illustrated in FIGS. 4 and 5 and the timing chart illustrated in FIG. 8. Either the driver seat switch 22 or the pillar portion switch 23 is first operated manually by the occupant. At step S5, the CPU 71 detects whether or not either the switch 22 or the switch 23 has sent an ON signal. If the determination in step S5 is YES, the program proceeds to step S6 for driving the electric releasing actuator 8, that is to drive the electric motor 81 so as to operate the hook mechanism 5. The hook mechanism 5 hence establishes the unhooked condition with the engagement pin being disengaged from the hook. Therefore, the vehicle door 1 is released from the door opened condition. Further, at step S6, the timer 74 commences counting almost simultaneously with the starting of the driving operation of the electric motor 81. The program then proceeds to step S7 at which the CPU 71 judges whether or not the actual time counted by the timer 74 from the starting of the driving operation of the electric motor 81 has reached a predetermined lapsed time TI.

If the judgment at step S7 is YES, the program precedes to step S8 for driving the electric sliding mechanism 9, that is to drive the electric motor 91 to rotate in a direction for slidably moving the vehicle door 1 in the closing direction to close the opening 21. The predetermined time T1 is preset to be equal to or greater than an operating time of the hook mechanism 5, i.e., the time required for establishing the unhooked condition with the engagement pin being disengaged from the hook. Therefore, when the affirmative judgment is obtained at step S7, the CPU 71 judges that the vehicle door 1 has been released from the door opened condition.

After step S8, the program proceeds to step S9 in which the CPU judges, based upon the signal from the position sensor 92, whether or not the position of the vehicle door 1 is beyond a predetermined door full-opened range L1 and the vehicle door 1 is positioned at a door closed side. If the judgment at step S9 is YES, the program directly proceeds to step S11 to terminate the driving operation of the electric motor 81 so that the hook mechanism 5 is returned to the hooked condition with the engagement pin being engaged with the hook. On the other hand, if the determination at step S9 is NO, the program proceeds to step S10 in which the CPU 71 judges whether or not the actual time counted by the timer 74 from the starting of the driving operation of the electric motor 81 has reached a predetermined lapsed time T2. If the determination in step S10 is YES, the program proceeds to step S11 to terminate the driving operation of the electric motor 81 so that the hook mechanism 5 is returned to the hooked condition with the engagement pin being engaged with the hook. The door full-opened range L1 is preset within a range of the position of the vehicle door 1 to be held under the door opened condition by the hook mechanism 5 establishing the hooked condition. The predetermined time T2 is preset to be equal to or greater than the time required to set the position of the vehicle door 1 beyond the door full-opened range LI by the electric sliding mechanism 9. Therefore, the CPU 71 reliably prevents at steps S9 and S10 the vehicle door 1 from being returned to the door opened condition.

At step S12, the CPU 71 judges whether or not the half-latch witch 42 outputs an OFF signal. If the determination in step S12 is YES, the CPU 71 judges that the larch mechanisms 3, 4 are under the half-latched condition in which the vehicle door 1 is under the door half-closed condition. The program then proceeds to step S13 to begin driving operation of the electric motor 45 of the electric closing mechanism 44, wherein the latch mechanisms 3, 4 are shifted from the half-latched condition to the full-latched condition. In other words, the vehicle door 1 is shifted from the door half-closed condition to the door full-closed condition. Next, at step S14, the CPU 71 judges whether or not the pawl switch 43 has been switched from ON to OFF during the shifting operation of the latch mechanisms 3, 4 from the half-latched condition to the full-latched condition. If the judgment in step S14 is YES, the program proceeds to step S15 to terminate the driving operation of the electric motor 91. At step S16, the CPU 71 judges whether or not the full-latch switch 41 is OFF. If the determination in step S16 is YES, the program proceeds to step S17 for judging again whether or nor the pawl switch 43 was switched from ON to OFF. If the judgment in step S17 is YES, the CPU 71 judges that the latch mechanisms 3, 4 are under the full-latched condition, i.e., the vehicle door 1 is under the door full-closed condition. The program then proceeds to step S18 for terminating the driving operation of the electric motor 45.

The opening operation of the vehicle door 1 is described below with reference to the flow charts illustrated in FIGS. 6 and 7 and the timing chart illustrated in FIG. 9. The driver seat switch 22 or the pillar portion switch 23 is first operated manually by the occupant. At step S19, the CPU 71 judges whether or not the driver seat switch 22 is ON. If the judgment is YES, the program then proceeds to step S21. On the other hand, if the determination at step S19 is NO, the program then proceeds to step S20 for judging whether of not the pillar portion switch 23 is ON. If it is determined at step S20 that the pillar portion switch 23 is ON (i.e, the determination in step S20 is YES), the program proceeds to step S22 for judging whether or not the child-protecting switch 67 is ON. If the judgment in step S22 is NO, the program advances to step S21.

At step S21, the CPU 71 judges whether or not the lock switch 66 is ON. If judgment is NO at step S21, the program proceeds to step S23 for driving the electric releasing actuator 8, that is for driving the electric motor 81 to operate the latch mechanisms 2, 3. The latch mechanisms 2, 3 then come under the unlatched condition with the latch being disengaged from the pawl. Therefore, the vehicle door 1 is released from the door closed condition. Further, at step S23, the timer 74 commences counting almost simultaneously with the starting of the driving operation of the electric motor 81. Next, at step S24, the CPU 71 judges whether or not the pawl switch 43 has been switched from OFF to ON. If the judgment in step S24 is YES, the CPU 71 judges that the latch mechanisms 3, 4 are under the unlatched condition with each latch being disengaged from the respective pawl. In this case, step S24 is followed by step S25 for driving the electric sliding mechanism 9, that is for driving the electric motor 91 to slidably move the vehicle door 1 in the direction for opening the opening 21.

On the other hand, if the determination in step S21 is YES, the CPU 71 judges that the vehicle door 1 is under the door locked condition. In this case, the program returns to the step S19. That is, the electric motors 81, 91 are not driven and the vehicle door 1 is not operated for effecting the opening operation. In addition, at least when either the lock switch 66 is ON or the child protecting switch 67 is ON, the CPU 71 judges that the vehicle door 1 is under the door locked condition or that the vehicle door 1 is under the child locking condition. In this case, the program does not proceed to step S23 for operating the electric releasing actuator 8. Therefore, the electric motors 81, 91 are not driven and the vehicle door 1 is not operated for the opening operation. Therefore, the vehicle door 1 is not undesirably moved in the opening direction for opening the opening 21, thereby assuring vehicle security.

After step S25, the program proceeds to step S26 at which the CPU 71 judges whether or not the half-latch switch 42 is ON. If the judgment in step S26 is YES, the CPU 71 judges that the latch mechanisms 3, 4 are under the unlatched condition. In this case, the program proceeds to step S27 for judging whether or not the estimated position of the vehicle door 1 based upon the signal from the position sensor 92 is at a predetermined door opening position P1. If the determination in step S27 is YES, the CPU 71 judges that the vehicle door 1 is positioned at a position in which the latch mechanisms 3, 4 are not operated for returning the vehicle door 1 to the door closed condition. In this case, step S27 is followed by step S28 for terminating the driving operation of the electric motor 81.

At step S29, the CPU 71 judges whether or not the estimated position of the vehicle door 1 based upon the signal from the position sensor 92 is within the predetermined door full-opened range L1. If the determination in step S29 is YES, the CPU 71 judges that the vehicle door 1 is at a position to be held under the door opened condition by the hook mechanism 8. In this case, step S29 is followed by step S30 for terminating the driving of the electric motor 91. The operation of the electric motor 91 is terminated by detecting an overload applied to the electric motor 91 due to a restriction of the vehicle door 1 at the door full-opened position by a stopping means.

If the judgments in steps S24 and S26 is NO, the program proceeds to steps S31, S32 respectively. At step S31, the CPU 71 judges whether or not the actual time counted by the timer 74 from the starting of the driving operation of the electric motor 81 at step S23 has reached a predetermined time T3. At step S32, the CPU 71 judges whether or not the actual time counted by the timer 74 from the starting of the driving operation of the electric motor 81 at step S23 has reached a predetermined time T4. Further, the predetermined time T3 is preset to be equal to or greater than a required time for switching the pawl switch 43 from OFF to ON. The predetermined time T4 is preset to be equal to or greater than a required time for turning ON the half latch switch 42. If the determination in steps S31 and S32 is YES by observing the actual time at each step by the CPU 71, the CPU 71 judges that the latch mechanisms 3, 4 are under the unlatched condition.

Further, the vehicle door opening and closing device described above can be provided with an assisting operation device to operate the electric sliding mechanism 9. The assisting operation device is employed for operating the electric sliding mechanism 9 based upon signals from the remote control mechanism 6, signals from the respective handle switches mounted on the inside handle 61 and the outside handle 62 for detecting the operation of the handles 61, 62, and signals from the full-latch switch 41, the half-latch switch 42 and the pawl switch 43 when the vehicle door 1 is slidably moved for opening and closing the opening 21 in response to the manual operation of the inside handle 61 and the outside handle 62 by an individual.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. A vehicle body of a vehicle comprising:

an opening which permits access into and out of the vehicle;

a vehicle door movably supported by the vehicle body for opening and closing the opening;

a hook mechanism which holds the vehicle door relative to the vehicle body under a door opened condition;

a moving mechanism which moves the vehicle door relative to the vehicle body;

an electric releasing actuator operatively connected to the hook mechanism to operate the hook mechanism and effect unhooking of the hook mechanism to permit the vehicle door to be moved in a closing direction to close the opening;

an electric driving device operatively connected to the moving mechanism to operate the moving mechanism and move the vehicle door in the closing direction relative to the vehicle body to close the opening;

operation means for generating a signal indicating that the vehicle door is to be moved in the closing direction to close the opening;

control means for controlling operation of the electric releasing actuator based on the signal from the operation means and controlling operation of the electric driving device to initiate driving of the moving mechanism after initiating operation of the electric releasing actuator.

2. The vehicle body according to claim 1, wherein the control means includes timing means for commencing counting of lapsed time from initiation of operation of the electric releasing actuator, the control means starting operation of the electric driving device and stopping operation of the electric releasing actuator based upon a lapsed time counted by the timing means.

3. The vehicle body according to claim 2, further comprising detecting means for detecting movement of the vehicle door relative to the vehicle body, the control means terminating operation of the electric releasing actuator based upon at least one of the movement of the vehicle door detected by the detecting means and the lapsed time counted by the timing means.

4. The vehicle body according to claim 1, wherein the operation means includes a manual switch which sends a signal to the control means upon manual operation of the manual switch.

5. The vehicle body according to claim 1, wherein the operation means operates the vehicle door to be set under a door full closed condition, a door half closed condition, and a door opening and closing condition.

6. The vehicle according to claim 1, including a latch mechanism movable between a full-latched condition, a half-latched condition and an unlatched condition, a full-latched switch detecting the full-latched condition of the latch mechanism and a half-latch switch detecting the half-latch condition of the latch mechanism.

7. A method for closing an opening defined in a vehicle body of a vehicle through movement of a vehicle door relative to the vehicle body comprising:

operating an electric release motor operatively connected to a hook mechanism holding the vehicle door at an open condition to unhook the hook mechanism, the driving of the electric release motor being initiated based upon operation of a switch;

counting lapsed time from initiation of the operation of the electric release motor;

judging whether the lapsed time from the initiation of the operation of the electric release motor is at least equal to a first predetermined time; and initiating driving of an electric driving mechanism for moving the vehicle door in a closing direction relative to the vehicle body based on whether the lapsed time from the initiation of operation of the electric release motor is at least equal to the first predetermined time.

8. The method according to claim 7, further comprising:

detecting a position of the vehicle door relative to the vehicle body; and terminating operation of the electric release motor based on the lapsed time from initiation of the operation of the electric release motor or the detected position of the vehicle door.

9. The method according to claim 7, further comprising:

determining whether a latch mechanism is in a half-latch condition; and operating a driving electric motor operatively connected to the latch mechanism when the latch mechanism is determined to be in the half-latch condition to move the latch mechanism to a full-latch condition.

10. The method according to claim 9, further comprising:

determining whether the latch mechanism is in a full-latch condition; and stopping operation of the driving electric motor that is operatively connected to the latch mechanism when the latch mechanism is determined to be in the full-latch condition.

11. The method according to claim 7, including initiating driving of the electric driving mechanism when the lapsed time from the initiation of operation of the electric release motor is at least equal to the first predetermined time, and stopping operation of the electric release motor when the lapsed time from the initiation of operation of the electric release motor is at least equal to a second predetermined time which is greater than the first predetermined time.

12. The method according to claim 7, further comprising:

detecting a position of the vehicle door relative to the vehicle body; and initiating driving of the electric driving mechanism when the lapsed time from the initiation of operation of the electric release motor is at least equal to the first predetermined time, and stopping operation of the electric release motor based on the detected position of the vehicle door.

13. A method for closing an opening defined in a vehicle body of a vehicle through movement of a vehicle door relative to the vehicle body comprising:

directing a door closing operation of the vehicle door that is in an open condition;

releasing a hook mechanism holding the door at the open condition by operation of a first motor operatively connected to the hook mechanism;

counting lapsed time from initiation of operation of the first motor; and operating a second motor to move the vehicle door relative to the vehicle body in a closing direction based upon the lapsed time from the initiation of operation of the first motor.

14. The method according to claim 13, further comprising:

detecting a position of the vehicle door relative to the vehicle body; and terminating operation of the first motor based upon the lapsed time from the initiation of operation of the first motor or the detected position of the vehicle door.

15. The method according to claim 13, further comprising:

determining whether a latch mechanism is in a half-latch condition; and operating a third motor operatively connected to the latch mechanism when the latch mechanism is determined to be in the half-latch condition to move the latch mechanism to a full-latch condition.

16. The method according to claim 15, further comprising:

determining whether the latch mechanism is in the full-latch condition; and stopping operation of the third driving motor when the latch mechanism is determined to be in the full-latch condition.

17. The method according to claim 16, further comprising:

stopping operation of the second motor after initiating operation of the third motor and before stopping operation of the third motor.

18. The method according to claim 13, further comprising judging whether the lapsed time from the initiation of operation of the first motor is at least equal to a first predetermined time, and initiating operation of the second motor when it is determined that the lapsed time from the initiation of operation of the first motor is at least equal to the first predetermined time.

19. The method according to claim 18, including stopping operation of the first motor when the lapsed time from the initiation of operation of the first motor is at least equal to a second predetermined time which is greater than the first predetermined time.

20. The method according to claim 18, further comprising:

detecting a position of the vehicle door relative to the vehicle body; and initiating operation of the second motor when the lapsed time from the initiation of operation of the electric releasing actuator is at least equal to the first predetermined time, and stopping operation of the first motor based on the detected position of the vehicle door.

* * * * *